United States Patent [19]

Hellnick

[11] Patent Number: 4,763,737

[45] Date of Patent: Aug. 16, 1988

[54] DOWNHOLE CUTTER

[76] Inventor: Dieter Hellnick, P.O. Box 681446, Houston, Tex. 77268-1446

[21] Appl. No.: 895,125

[22] Filed: Aug. 11, 1986

[51] Int. Cl.[4] ..... E21B 10/58; E21B 10/60

[52] U.S. Cl. ..... 175/393; 175/385; 175/410

[58] Field of Search ..... 175/393, 391, 385, 399, 175/402, 403, 404, 405, 377, 396, 417, 410

[56] References Cited

U.S. PATENT DOCUMENTS

| | | | |
|---|---|---|---|
| 2,214,238 | 9/1940 | Stovall | 175/403 X |
| 2,412,939 | 12/1946 | Aston | 175/403 X |
| 2,520,876 | 8/1950 | Bullock | 175/403 |
| 3,692,125 | 9/1972 | Ruhle | 175/65 |
| 3,951,220 | 4/1976 | Phillips, Jr. et al. | 175/404 X |
| 4,440,247 | 4/1984 | Sartor | 175/393 |

*Primary Examiner*—Stephen J. Novosad

*Attorney, Agent, or Firm*—Bernard A. Reiter; Mark G. Bocchetti

[57] ABSTRACT

Disclosed is a drill bit for use downhole in oil and gas wells. It is particularly adoptable for use in removing obstructions such as well packers which may become jammed within the casings of oil and gas wells. Cutters are arranged on the cutting face of the drill bit in arc-like patterns of decreasing radius. The shear angle of each cutter combined with the arc-like pattern in which the cutters are arranged serve to direct the cuttings and drilling debris inward toward the central bore. Fluid can be pumped down through the well casing and circulated about the drill bit through longitudinal channels provided in the main body of the drill bit. In such manner, the fluid circulates downward within the casing and across the cutting face of the drill bit carrying the cuttings and drilling debris up through the central bore thus preventing the cuttings in drilling debris from building up within the casing or causing the drill bit to jam within the casing.

14 Claims, 3 Drawing Sheets

DOWNHOLE CUTTER

BACKGROUND OF THE INVENTION

1. Field of the Invention

This invention relates generally for drill bits and cutters used downhole in oil, gas or other type wells and particularly to cutters and drill bits for the removal of obstructions jammed in the casings of such wells.

2. Brief Description of the Prior Art

Well packers have, on occasion, been known to jam within the casing of oil and gas wells. When this occurs, there has been no practical means for removing the packer from the casing. Attempts to drill out or through the jammed packer with conventional drill bits have proved unsuccessful. Typically, the debris created by the drilling operation becomes jammed between the drill bit and the casing. The net result is that the drilling operation cannot be continued and often, the drill bit itself also becomes jammed within the well and is lost. When a packer becomes jammed in the casing of an oil or gas well and cannot be removed, the well is lost.

U.S. Pat. No. 2,663,546 to Kammerer is a conventional drill bit in terms of its operation and design. Kammerer apparently teaches a rotary drill bit having a center bore through which drilling fluid is pumped downward such that the fluid pushes the cuttings outward from the cutters washing them toward the well bore and then upward. The Kammerer drill bit would therefore be totally unsatisfactory for the removal of items such as well packers which become jammed within a well casing. The cuttings would become jammed between the drill bit and the casing preventing such cuttings from being flushed from the casing. This would result in a build-up of cuttings between the drill bit and the jammed packer. Ultimately, either the drill bit would seize cutting further into the jammed packer due to the build-up of cuttings or, the build-up of cuttings would cause the drill bit to seize or jam within the casing preventing further rotational movement.

U.S. Pat. No. 3,385,385 to Kucera et al teaches a roller drill bit for drilling through earth formations. The design of the cutters of Kucera et al do not direct the cuttings and debris inward nor does Kucera et al teach the flushing of the debris inward and up through the center bore of the drill bit. As such, the Kucera et al drill bit design is insufficient for the removal of well packers or other items which may become jammed within the casing of an oil or gas well.

U.S. Pat. No. 3,126,973 to Kiel teaches yet another rotary drill bit directed to drilling through earth formations. Kiel's drill bit is three conical cutters which have noncircular rows of teeth. The purpose of the noncircular rows of teeth is apparently to generate a vibratory action to increase penetration. The shaft is provided with a center bore through which fluid is pumped downward to flush debris outward from the drill bit. As such, the Kiel drill bit design is inadequate for the purpose of removing well packers or other items jammed within the casing of oil and gas wells.

U.S. Pat. No. 3,081,829 to Williams, Jr. teaches yet another drill bit design directed to boring holes into earth formations. As is the case with the prior art patents previously mentioned, Williams, Jr. does not teach cutters which direct the cuttings inward toward the center of the drill bit nor does it teach the flushing of such cuttings upward through the central bore of the bit. The same can be said for U.S. Pat. Nos. 2,094,856 to Smith et al and 2,533,260 to Woods. None would be adaptable for use in drilling out or through packers or other items jammed within the casing of an oil or gas well.

SUMMARY OF THE INVENTION

It is therefore an object of the present invention to provide a drill bit which can drill out and/or through well packers or other items which become jammed within the casing of an oil or gas well.

It is a further object of the present invention to provide a drill bit which prevents the cuttings and debris from becoming jammed between the drill bit and the well casing.

Yet another object of the present invention is to provide a drill bit in which the cutters are designed and arranged such that they direct the cuttings inwardly toward the axial center of the drill bit.

A further object of the present invention is to provide a drill bit which controls the size of the cuttings it creates.

Still another object of the present invention is to provide a drill bit in which the cuttings are flushed upward through the central bore of the drill bit and stem.

Briefly stated, the foregoing and numerous other objects and advantages of the present invention are accomplished by arranging the cutters on the drill bit in arcs of decreasing radius and positioning such cutters so that they cutting face of each cutter directs the cuttings inwardly toward the center of the drill bit. The drill bit has a central bore through which cuttings and debris may be flushed to the surface. Fluid is pumped down the casing between the drill bit and the casing. The drill bit is provided with notches or channels in its circumference to permit the fluid to pass freely between the drill bit and the well casing. In this manner, the fluid crosses the face of the drill bit thereby flushing the cuttings and debris from the cutters inward to the central bore.

As stated above, the cutters are arranged in arcs of decreasing radius. Depending on the diameter of the drill bit, the cutters may be arranged in 1, 2, 3 or 4 arcs. Regardless of the number of arcs, the lead cutter of each arc is disposed at a position furthest from the central axis of the drill bit. The cutters which follow are each disposed slightly inwardly toward the central axis of the drill bit from the cutter immediately in front of it in the arc. In such manner, the cutters on a single arc can be made to slightly overlap one another to cut one broad surface in a series of narrow shavings. Alternativley, the cutters can be spaced such that as they cut a gap is left in the surface between cut between one cutter and the next thus creating a rake pattern. The high points left in the rake pattern would be cut by a second arc of cutters.

The cutters are positioned such that their cutting surface is offset 30° inwardly form a line projecting radially outwardly from the center of the drill bit. This directionining of the cutters aids in projecting the cuttings inwardly toward the center. Further, the back of each cutter is sloped in such manner toward the center of the drill bit that as cuttings curl forward from each cutting face, should they begin to move outwardly, they will encounter the sloped rear face of the cutter immediately in front and be deflected toward the central bore of the drill bit.

Each drill bit is provided with two governors which control the depth of cut that each cutter makes. Such governors are actually cylindrical pieces of carbide having a flat surface projecting outward from the drill bits substantially parallel to the cutters. The flat surfaces are set such a distance such that they project from the drill bit slightly less than the cutting surface of each cutter. This difference in extension between the cutter and the governor prevents the cutter from gouging deeply into the surface being cut and allows one to set the maximum thickness of the individual cuttings. Thus, not only does the present invention direct the cuttings inwardly, but it also controls the width and thickness of each cutting thus making sure that the central bore does not become plugged with large pieces of debris so that flushing can be continuous.

Each drill bit is also provided with two other cutting surfaces located at 180° apart from one another at the extreme outside of the drill bit. These cutting surfaces provide backup should one of the lead cutters become damaged or broken. Each of the secondary cutters is provided with a sloped shoulder which rises to a flat surface projecting from the drill bit an identical distance as each of the governors. In such manner, these shoulders on the secondary cutters also govern the depth of cut.

DESCRIPTION OF THE PREFERRED EMBODIMENT

Figure 11:
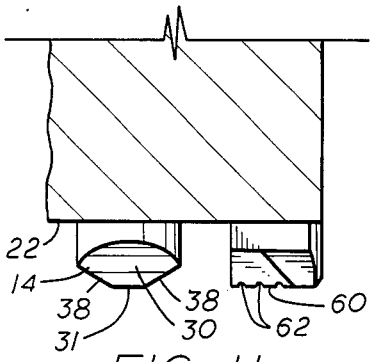
FIG. 11 is a partial section taken along lines 11—11 of FIG. 8.
Figure 12:
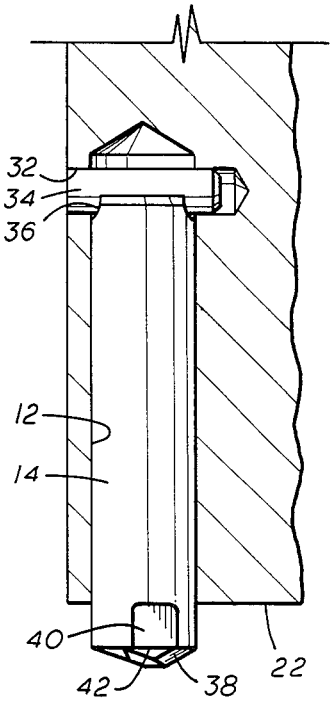
FIG. 12 is a partial section taken along lines 12—12 of FIG. 8.
Figure 13:
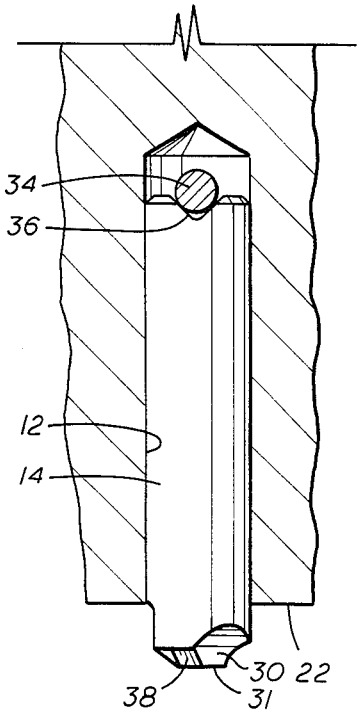
FIG. 13 is a partial section taken along lines 13—13 of FIG. 8.
Figure 1:
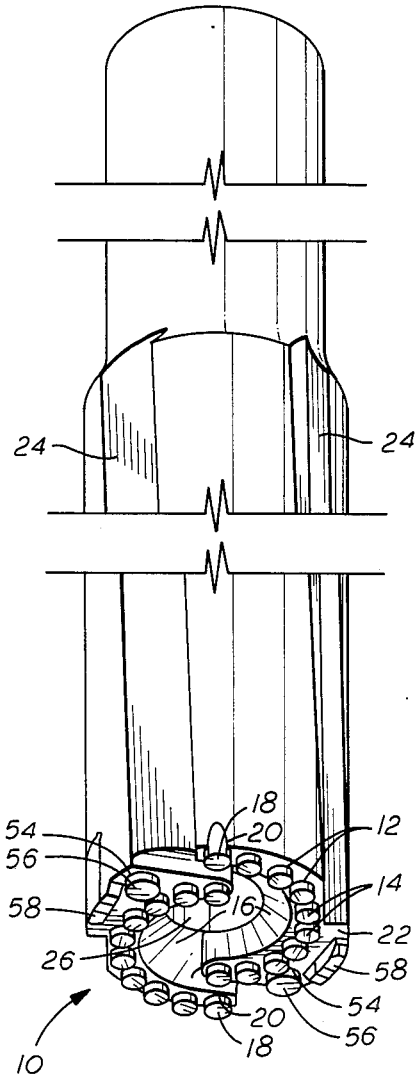
FIG. 1 is an isometric view of the drill bit of the presnt invention.
Figure 14:
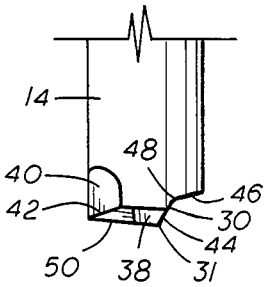
FIG. 14 is a detailed partial elevation of the cutter of the present invention.
Figure 15:
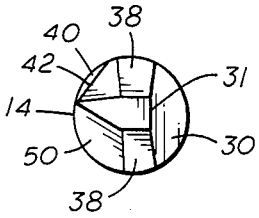
FIG. 15 is a detailed end view of the cutter of the present invention.
Figure 16:
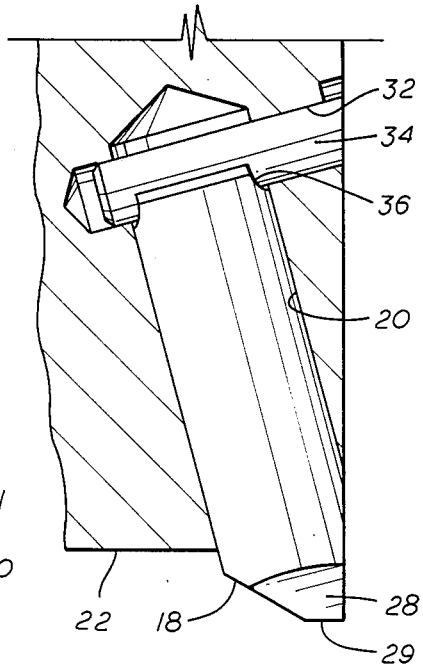
FIG. 16 is a partial section taken along lines 16—16 of FIG. 8.
Figure 2:
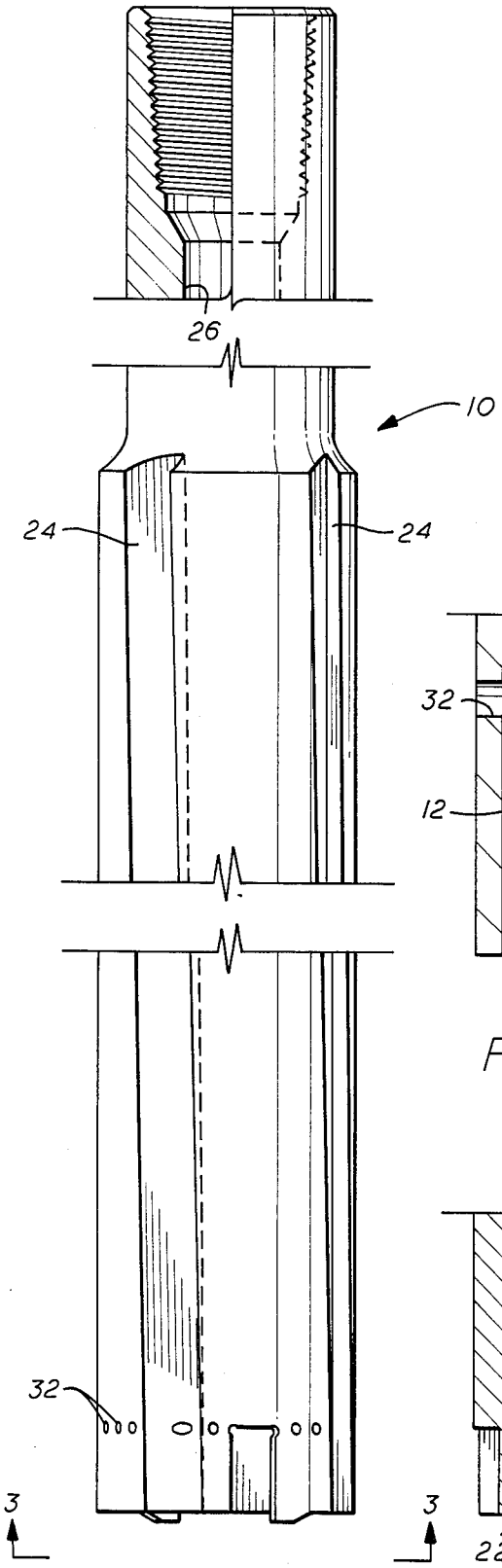
FIG. 2 is an elevational view of the main body of the drill bit of the present invention.
Figure 3:
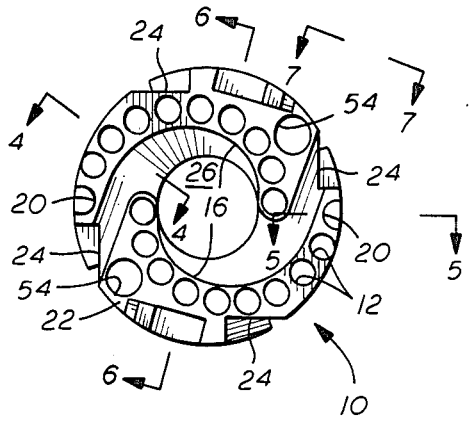
FIG. 3 is an end view of FIG. 2 taken along lines 3—3.
Figure 4:
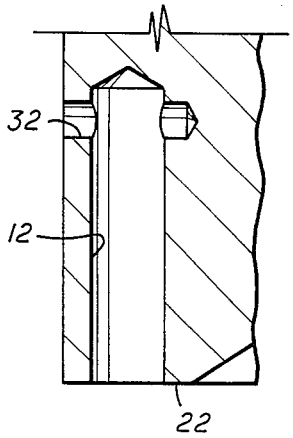
FIG. 4 is a detailed partial section taken along lines 4—4 of FIG. 3.
Figure 5:
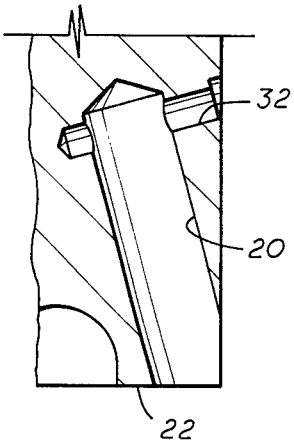
FIG. 5 is a partial section taken along lines 5—5 of FIG. 3.
Figure 6:
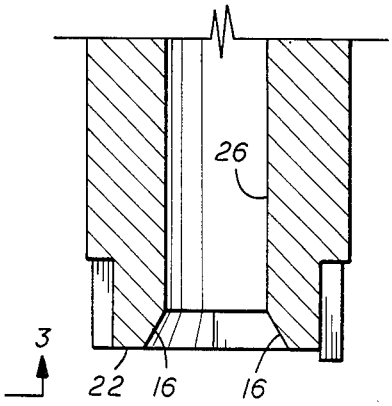
FIG. 6 is a sectional view taken along lines 6—6 of FIG. 3.
Figure 7:
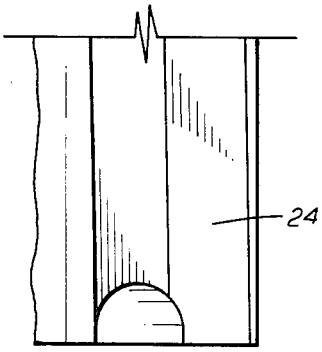
FIG. 7 is a partial section taken along lines 7—7 of FIG. 3.
Figure 8:
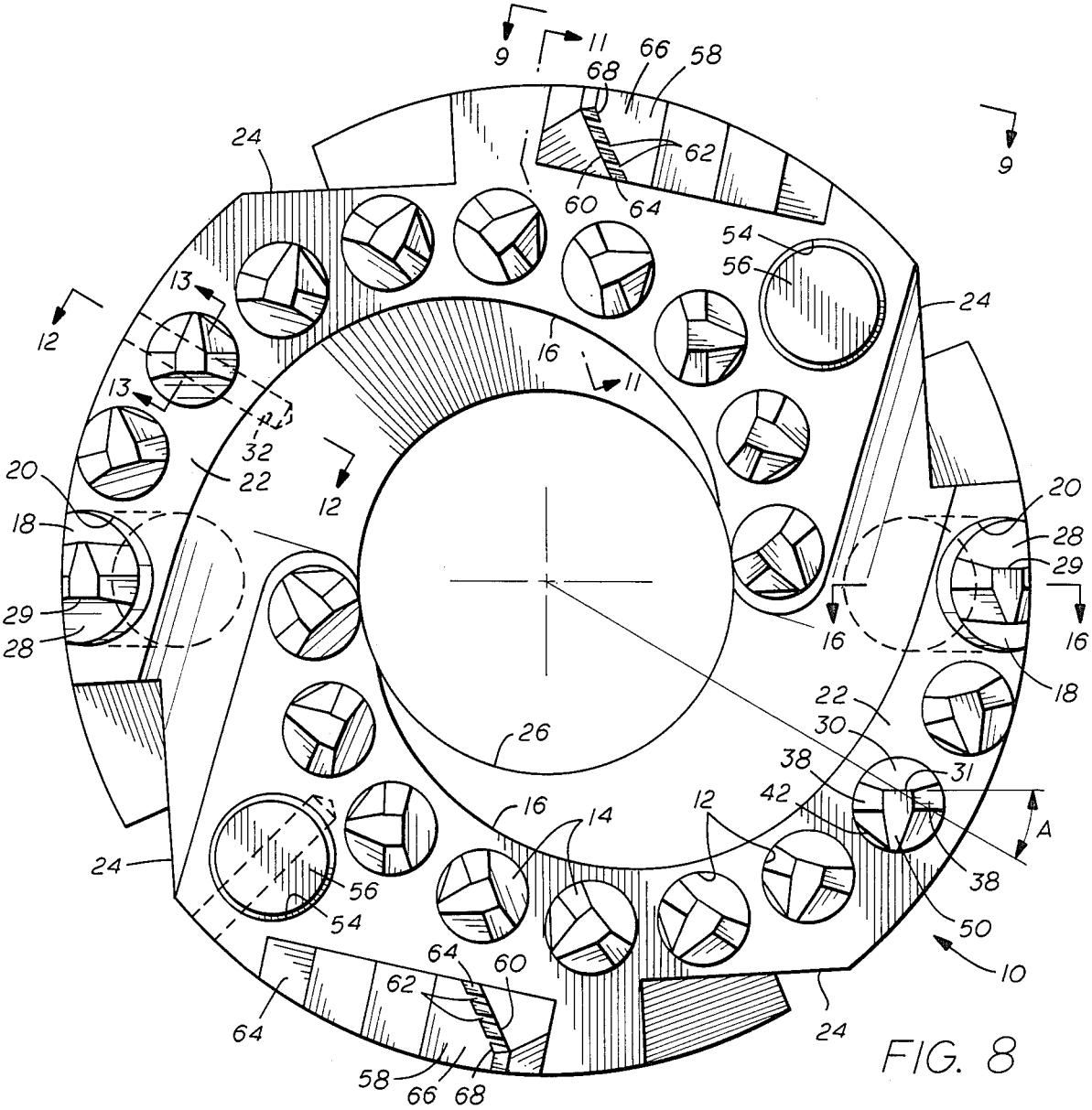
FIG. 8 is an end view of the drill bit of the present invention.
Figure 9:
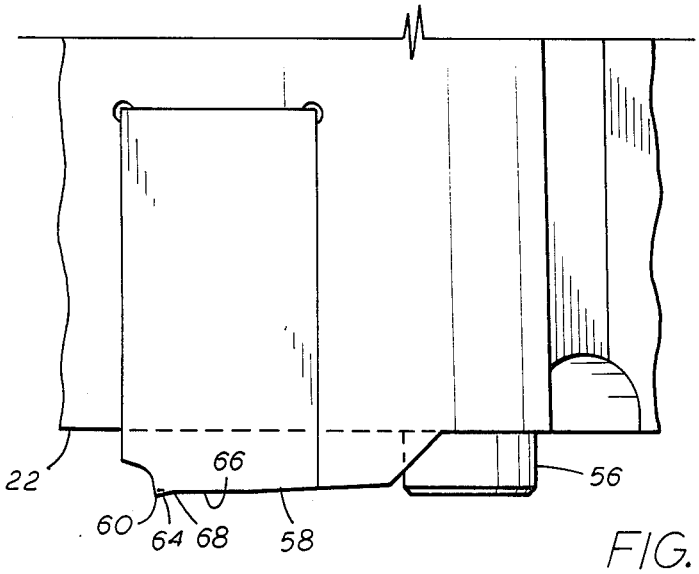
FIG. 9 is a partial section taken along lines 9—9 of FIG. 8.
Figure 10:
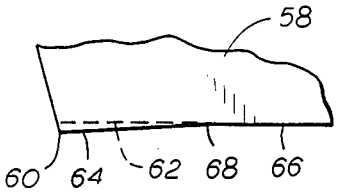
FIG. 10 is an enlarged view of the cutting edge of the secondary cutters.

Turning first to FIG. 1, there is shown the drill bit 10 of the present invention. Drill bit 10 is substantially cylindrical in shape and has in its face a series of bores 12 which provide residence for cutters 14. Bores 12 and consequently cutters 14 are arranged in arcs or flutes 16 of decreasing radius. The lead cutter 18 of each arc or flute 16 is disposed such that its cutting path is slightly inside the outside diameter of the drill bit 10. Because of its position at the outside diameter of the drill bit 10, lead cutter 18 and its corresponding bore 20 cannot be perpendicular to the face 22 of the drill bit 10. Therefore, bore 20 and lead cutter 18 are directed into drill bit 10 at an angle which converges with the central axis of the drill bit 10.

Notches or channels 24 are placed along the cylindrical surface of drill bit 10. These notches or channels 24 allow fluid to be pumped down through the well casing between the drill bit 10 and the well casing. When the fluid is pumped in such manner, it flows across the cutters 14 substantially radially inward toward the central bore 26. In such manner, the cuttings and drilling debris are flushed inwardly from the cutters 14 and up the central bore of the drill bit 10 where they exit the well. The area of the notches or channels 24 is substantially equal to the area of the central bore 26 so that a steady flow rate can be maintained for the fluid entering and exiting the well.

The cutting face 28 and cutting edge 29 of the lead cutters 18 are substantially parallel to a line projecting radially from the central axis of the drill bit 10. In other words, the cutting face 28 and cutting edge 29 of the lead cutter 18 are substantially perpendicular to the arc of rotation of the drill bit 10. The cutting faces 30 and cutting edges 31 of the trailing cutters 14 are positioned such that they create an angle of intersection A with a line extending radially from the center of drill bit 10. It is preferable that this angle A be 30° but experiments have shown that angles of 10° through 40° will work effectively. This angle A of cutting faces 14 help direct the cuttings and drilling debris inwardly toward the central bore 26.

The lead cutter 18 and trailing cutters 30 may be positioned such that they slightly overlap one another progressively inward along arc or flute 16. In such manner, the cutters 14, 18 in each arc or flute 16 cut the same area. Alternatively, the cutters 14, 18 can be positioned such that there is a gap in the cutting path between cutting edges 29, 31. In this manner, each arc or flute 16 would cut a rake-like pattern into the surface being cut thus creating a series of arcuate grooves and ridges. The cutters 14, 18 of the second arc or flute 16 would be positioned such that their cutting edges 29, 31 would cut the ridges of material left by the first arc or flute 16 of cutters 14, 18. Drill bit 10 is provided with a series of radial bores 32 drilled radially inward from the cylindrical surface of drill bit 10 in close proximity to the face 22 of drill bit 10. These bores 32 provide residence for locking pins 34. There is one bore 32 and locking pin 34 corresponding to each cuttter 14, 18. Each of the bores 32 intersects a corresponding bore 12, 20 perpendicularly. Thus, with the exception of the bores 32 corresponding to lead cutter(s) 18 and its bore(s) 20, all bores 32 are directed substantially perpendicular to the central axis of the drill bit 10.

At the base of each cutter 14, 18 there is a V-notch 36. The interaction between each V-notch 36 and its corresponding locking pin 34 prevents rotational movement of the cutters 14, 18 and allows cutting faces 28, 30 to be fixed in the desired positions thus setting the value for angle A. Further, the interaction of each V-notch 36 and its corresponding locking pin 34 precisely sets the distance each cutting edge 29, 31 extends from face 33.

Each cutter 14 has shoulders 38 which slope away from cutting edge 31 thus creating clearance angles for each cutter 14. It is preferable that such clearance angles be approximately 30° however, it is noted that clearance angles of 5° through 60° have been found to be acceptable. It is also noted that it is not necessary that the clearance angles be equivalent.

Toward the rear of each cutter 14 there is a deflecting slope 40. The angle created between the top 42 of deflecting slope 40 and the cutting face 30 is 35°. This deflector angle aids in directing cuttings which may curl off one of the trailing cutters 14 toward the central bore 26. Deflector slope 40 rests at an angle of approximately 5° from vertical.

Cutting face 30 preferably has a depth of 0.110 inches but depths varying from 0.020 inches through 0.200 inches have been found to be adequate depending primarily on the type of material being cut.

Cutting face 30 is comprised of intersecting slopes 44 and 46. Slope 44 lies at an angle of 18° from the vertical while slope 46 lies at an angle of 18° from the horizontal. However, it should be understood the angles of slopes 44 and 46 may vary from 0° to 30° and need not be equivalent to one another again depending on material being cut. Slopes 44 and 46 intersect at radius 48. Radius 48 is preferably 0.062 inches but tests have shown that radii varying from 0.020 inches to 0.100 inches and greater are adequate. As is the case with other dimensions specified herein, dimensions outside the ranges given may also be acceptable.

The top rear portion 50 of each cutter 14 slopes back from cutting edge 31 at an angle of approximately 7° and increases to 15°. The width of cutting edge 31 determines the width of the cutting removed as drill bit 10 rotates. Because it is desired to keep the cuttings relatively small to make sure that central bore 26 does not become clogged, the width of cutting edge 14 should generally be no greater than 3/16ths of an inch. However, the width of cutting edge 14 may even become greater depending on the diameter of the bit 10 and type of material being cut. Preferably, the width of cutting edge 31 should be maintained at 0.100 inches.

The overall dimensions of each cutter 14, of course, may vary depending upon the diameter of the drill bit 10 in which they are used. However, it has been found that an overall length of 1.5 inches and a diameter of 0.375 inches works well.

The face 33 of drill bit 10 is also provided with two larger cylindrical bores 54 which are parallel to the cylindrical axis of drill bit 10. Cylindrical bores 54 provide residence for feed control rods 56. Feed control rods 56 extend outwardly or downwardly from the face 22 of drill bit 10 to a distance which is slightly less than the distance which cutting edges 29, 31 extend from the face 22 of drill bit 10. The large flat surface provided by feed control rod 56 acts as a governor which prevents cutting edges 29, 31 and cutting faces 28, 30 from gouging too deeply into the article being cut and therefore prevents cutting edges 29, 31 and cutting faces 28, 30 from taking overly thick cuttings. It has been found that it is preferable to allow cutting edges 29, 31 to extend approximately 0.002–0.003 inches further from the face 22 of drill bit 10 than does feed control rod 56 when cutting through materials such as Hastelloy or Inconel. If the material being cut was steel, it would be preferable to allow cutting edges 29, 31 to extend approximately 0.010 inches further from the face 22 of drill bit 10 than does feed control rod 56. This will allow cutting edge 52 and cutting face 30 to cut very fine shavings from the article which is jammed in the well casing. These fine shavings are easily directed and flushed to the central bore 26.

The face 22 of drill bit 10 is also provided with secondary cutters 58 disposed toward the outside diameter of drill bit 10. Secondary cutters 58 provide back-up cutting capability should one of the lead cutters 18 become damaged or broken. Further, secondary cutters 58 provide substantially full diameter cutting capability for the drill bit 10. The cutting edge 60 of secondary cutter 58 is provided with a series of notches 62 which serve to limit the width of the cuttings delivered by secondary cutters 58. Cutting edge 60 is the furthest extending portion of secondary cutter 58 downwardly from the face 22 of drill bit 10. Shoulder 64 which projects rearward from cutting edge 60 slopes downward toward the face 22 of the drill bit 10. Shoulder 64 then intersects with planar surface 66 thus creating a valley 68 behind cutting edge 60. Planar surface 68 serves as a secondary governor or feed control. Planar surface 68 extends from the face of drill bit 10 slightly less than cutting edge 60 extends from the face 22 of drill bit 10. It is preferably that this dimension be equal to the difference that cutting edges 29, 31 extend beyond feed control rod 56.

In the preferred embodiment, each of the cutters 14, 18, 58 are carbide and are silver soder brazed in place. However, cutters 14, 18, 58 may be press-fitted, screwed or brazed in place.

In operation, a series of fine cuttings are removed from the article which is jammed within the well casing. These cuttings are directed inwardly toward the central bore 26 by cutters 14, 18, 58. Further, the cuttings are flushed inwardly toward central bore 26 by fluid which is circulated between drill bit 10 and the well casing through notches or channels 24. In such manner, the cuttings are prevented from becoming jammed between the drill bit and the well casing or from building up between the drill bit 10 and the well casing. Substantially all of the cuttings are flushed upward through central bore 26 and out of the well.

From the foregoing, it will be seen that this invention is one well adapted to attain all of the ends and objects hereinabove set forth, together with other advantages which are obvious and which are inherent to the device.

It will be understood that certain features and subcombinations are of utility and may be employed with reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A downhole drill bit for use in well casings comprising:

(a) a substantially cylindrical main body having proximal and distal ends;

(b) a plurality of cutters mounted in said distal end of said main body having cutting edges extending beyond said distal end, said cutters being mounted in a substantially co-planar, arc-like pattern of decreasing radius;

(c) a plurality of channels in the perimeter of said main body running substantially longitudinally along said main body for allowing fluid to pass downward about the outside of said main body;

(d) a central bore through said main body along the cylindrical axis of said main body, said central bore receiving the fluid delivered through said plurality of channels along with any cuttings and debris flushed from said cutters and said distal end of said main body, the fluid, cuttings and debris conducted out of the well through said central bore.

2. A drill bit for use downhole to remove primarily metallic obstructions in well casings comprising:

(a) a substantially cylindrical main body having proximal and distal ends, said main body adapted to connect to a drill stem at said proximal ends;

(b) a plurality of cutters extending longitudinally from said distal end of said main body, each of said cutters having a cutting edge, all of said cutting edges residing substantially in a single plane;

(c) a central bore through said main body along the central axis of said main body;

(d) means for circulating fluid downward in the well casing about the outside of said main body across said cutters and said distal end of said main body and upward through said central bore thereby carrying away any cuttings and drilling debris from said cutters and said distal end of said main body.

3. A drill bit for use downhole to remove obstructions from well casings as recited in claim 2, wherein:

said plurality of cutters is arranged in a plurality of arc-like patterns of decreasing radius.

4. A drill bit for use downhole to remove obstructions from well casings as recited in claim 2, further comprising:

a cutting edge on each of said cutters, said cutting edge oriented to have a shear angle between 10° and 80°.

5. A drill bit for use downhole to remove obstructions from well casings as recited in claim 4 wherein:

said cutting edges of said cutters cut in narrow, overlapping, circular paths when said main body is rotated.

6. A drill bit for use downhole to remove obstructions from well casings as recited in claim 2, further comprising:

a cutting edge on each of said cutters, said cutting edge oriented to have a shear angle between 10° and 40°.

7. A drill bit for use downhole to remove obstructions from well casings as recited in claim 6, further comprising:

a deflector slope formed on each of said cutters behind said cutting edges to aid in directing any cuttings and debris toward said central bore.

8. A drill bit for use downhole to remove obstructions from well casings as recited in claim 6, wherein:

said cutting edges of said cutters cut in narrow, overlapping, circular paths when said main body is rotated.

9. A drill bit for use downhole to remove obstructions from well casings as recited in claim 2, further comprising:

at least one feed control means for limiting the depth of cut of said cutters.

10. A drill bit for use downhole to remove obstructions from well casings as recited in claim 9, wherein:

said feed control means are flat surfaces which extend from said distal end of said main body a distance slightly less than the distance of said cutters extend from said main body.

11. A drill bit for use downhole to remove obstructions from well casings as recited in claim 2, further comprising:

a plurality of secondary cutters mounted to said main body at the perimeter of said distal end of said main body.

12. A drill bit for use downhole to remove obstructions from well casings as recited in claim 2, further comprising:

a plurality of channels in the perimeter of said main body running substantially longitudinally along said main body for allowing fluid to pass downward within the well casing and about the outside of said main body.

13. A drill bit for use downhole to remove obstructions from well casings as recited in claim 12, wherein:

the sum of the cross-sectional area of said channels is substantially equal to the cross-sectional area of said central bore.

14. A downhole drill bit for use in well casings comprising:

(a) a substantially cylindrical main body having proximal and distal ends;

(b) a plurality of cutters mounted in said distal end of said main body, said cutters extending from said distal end of said main body and arranged in an arc-like co-planar pattern of decreasing radius, said arc-like pattern having a single lead cutter and a plurality of trailing cutters;

(c) a plurality of channels in the perimeter of said main body running substantially longitudinally along said main body for allowing fluid to pass downward about the outside of said main body;

(d) a central bore through said main body along the cylindrical axis of said main body, said central bore receiving the fluid delivered through said plurality of channels along with any cuttings and debris flushed from said cutters and said distal end of said main body, the fluid, cuttings and debris conducted out of the well through said central bore.

* * * * *